US006232249B1

(12) United States Patent
Kawada

(10) Patent No.: US 6,232,249 B1
(45) Date of Patent: May 15, 2001

(54) SHORT FIBER-CONTAINING DOWN-FEATHER WADDING AND PROCESS FOR PRODUCING THE SAME

(76) Inventor: Yukihiro Kawada, 16, Kamiishikawacho 1 -chome, Nakamura-ku, Nagoya-shi, Aichi-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/852,163

(22) Filed: May 6, 1997

(30) Foreign Application Priority Data

| | | |
|---|---|---|
| May 8, 1996 | (JP) | 8-113941 |
| Feb. 5, 1997 | (JP) | 9-022450 |
| Mar. 31, 1997 | (JP) | 9-080085 |
| Apr. 17, 1997 | (JP) | 9-100199 |

(51) Int. Cl.[7] ..... D04H 1/70

(52) U.S. Cl. ..... 442/352; 442/344; 442/351; 442/415; 442/416; 428/332

(58) Field of Search ..... 442/334, 340, 442/341, 344, 351, 352, 415, 416, 417; 428/332

(56) References Cited

U.S. PATENT DOCUMENTS 4,134,167 * 1/1979 Kazuo .
4,837,067 * 6/1989 Carey, Jr. et al. ..... 428/108

FOREIGN PATENT DOCUMENTS 54-027069 * 3/1979 (JP) .

* cited by examiner

*Primary Examiner*—Elizabeth M. Cole
(74) *Attorney, Agent, or Firm*—Armstrong, Westerman, Hattori, McLeland & Naughton, LLP

(57) ABSTRACT

A short fiber-containing down-feather wadding in which the short fibers are entangled in barbs of the down-feathers. In this wadding, the short fibers are uniformly mixed with the down-feathers, and the properties of the down-feathers, and the short fibers are effectively imparted to the wadding.

6 Claims, 5 Drawing Sheets

SHORT FIBER-CONTAINING DOWN-FEATHER WADDING AND PROCESS FOR PRODUCING THE SAME

BACKGROUND OF THE INVENTION

1. Field of the Invention

The present invention relates to a short fiber-containing down-feather wadding and a process for producing the same. More specifically, the present invention relates to a down-feather wadding in which functional chemical fibers are uniformly mixed with down-feathers and a process for producing the same.

The down-feather wadding here referred to means a wadding containing a mixture of downs and feathers having an excellent heat-retaining property at a ratio of from 0 to 100%. The downs refer to those in which yarn-like barbs are grown on tips of quills (attached to the skin of fowl through bases), and the feathers refer to those in which many barbs are grown on quills in rows and tiny barbs are further grown on the barbs in rows.

2. Description of Related Art

Down-feathers find wide acceptance in a down-feather mattress or comforter, a feather pillow, down-wear, a sleeping bag and the like.

It is sometimes requested to impart a far-infrared effect, a deodorant activity, a microbicidal activity, an acaridan-proof, a fire resistance and the like to down-feathers.

However, down-feathers are usually collected from waterfowl such as geese, ducks and the like, and have a high level of a water repellency (a ratio of a nonpolar amino acid is high on surfaces thereof). Accordingly, it was ordinarily difficult to impart activities by dissolving chemicals in a warm water bath and absorbing the same into down-feathers with stirring.

Meanwhile, it is also considered that chemical or natural fibers which have been subjected to the above mentioned treatment are mixed with down-feathers (in the case of chemical fibers, the chemicals can be incorporated therein at the spinning stage).

For example, rayon, polyester fibers, acrylic fibers and polyamide fibers which are typical chemical fibers are all polar materials. Cotton, hemp, silk and wool are fibers having a cellulose structure or a peptide structure, and these are also polar materials.

SUMMARY OF THE INVENTION

It is an object of the present invention to provide a novel short fiber-containing down-feather wadding in which synthetic or natural fibers are uniformly incorporated into down-feathers, and a process for producing the same.

The short fiber-containing down-feather wadding of the present invention is a down-feather wadding in which short fibers are incorporated in down-feathers. The above-mentioned object is achieved by entangling short fibers into barbs of down-feathers.

A process for producing short fiber-containing down-feather wadding in the present invention is a process for producing short fiber-containing down-feather wadding in which the short fibers are entangled in the down-feathers. The above-mentioned object is achieved by a process which comprises (1) a washing step of washing down-feathers in a cleaning bath in which a detergent is dissolved in water, and then rinsing and dehydrating the same, (2) a softening treatment step of softening the short fibers in a softening bath in which a surfactant-type softener is dissolved in water while stirring the same, (3) an entangling step of charging and stirring the washed down-feathers in the softening bath in which the short fibers softened are dispersed to entangle the short fibers into the barbs of the down-feathers, and (4) a heat-setting step of dehydrating and drying the mixture entangled, and then heat-setting the product entangled.

Consequently, in the short fiber-containing down-feather wadding of the present invention, the short fibers are entangled in the barbs and the tiny barbs with knots of the down-feathers, that is, the short fibers formed of synthetic or natural fibers are uniformly incorporated therein inseparably, making it possible to impart the properties of the short fibers to the down-feather wadding. Further, the short fibers are heat set, so that these short fibers are curled and hardly separated from the down-feathers. Especially when functional fibers are used as short fibers, it is possible to impart a far-infrared effect, an anion effect, an exothermic effect, a deodorant activity, a microbicidal activity, an acaridan-proof, a fire resistance and the like to a down-feather wadding.

The other process for producing a short fiber containing down-feather wadding in the present invention comprises charging washed down-feathers (including refined down-feathers) into a mixer, then charging short fibers which have been loosened using a short fiber loosening machine, and mixing the down-feathers with the short fibers in the mixer.

Accordingly, the other process can dispense with 1) the entangling step of charging and stirring the down-feathers into the softening bath in which the short fibers softened are present to entangle the short fibers into the barbs of the down-feathers, and 2) the step of dehydrating and drying the mixture entangled.

Therefore, the process for producing the short fiber-containing down-feather wadding and the apparatus used in the same in the present invention have outstanding effects that the short fiber-containing down-feather wadding in which the short fibers are entangled in the barbs of the down-feathers can be produced by a relatively small number of steps.

DESCRIPTION OF THE PREFERRED EMBODIMENTS

A. The short fiber-containing down-feather wadding of the present invention is described in detail below. In the following description, "parts" and "%" are by weight unless otherwise indicated.

Figure 1:
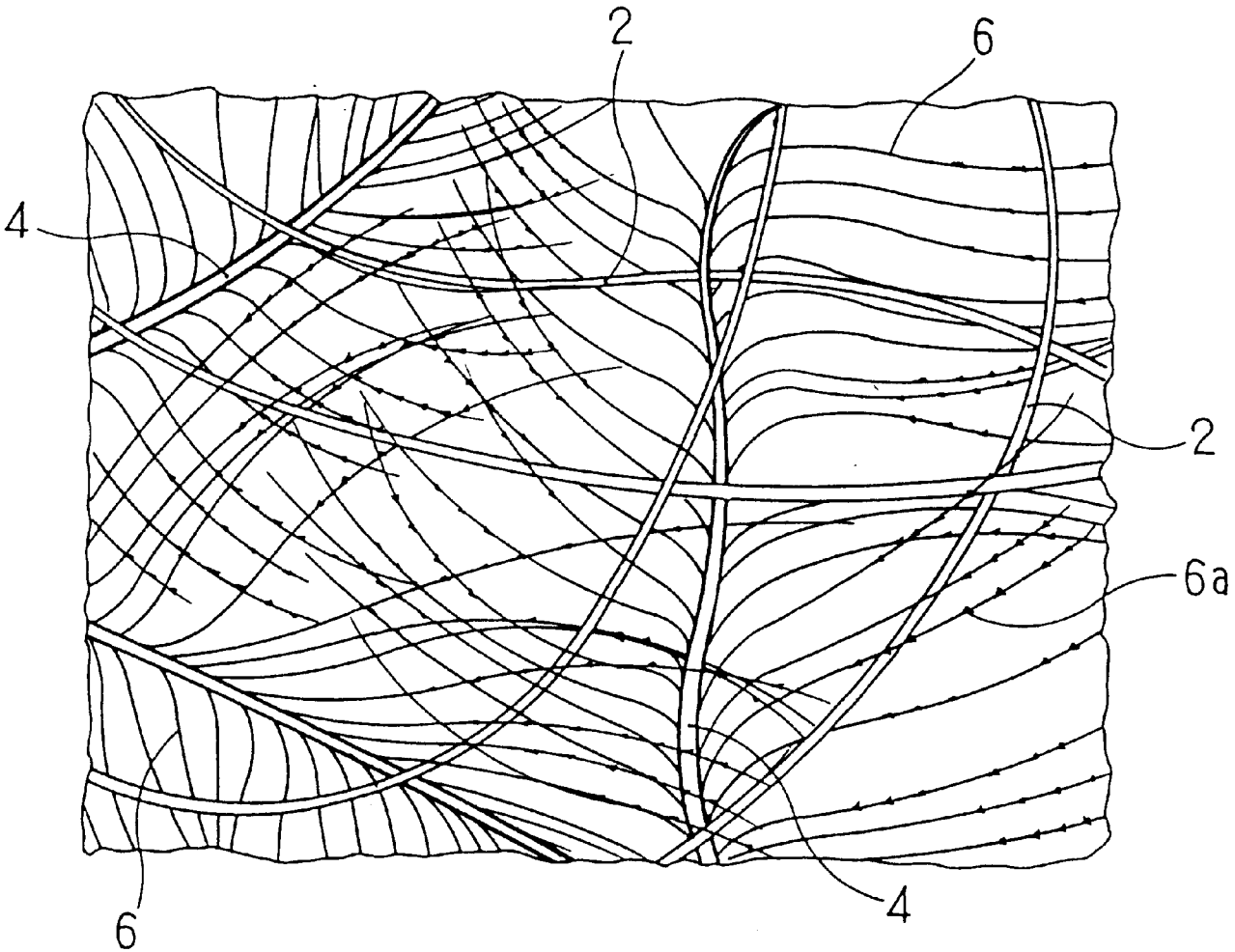
FIG. 1 is a view showing an entangled state of a short fiber-containing down-feather wadding in the present invention.

(1) In the short fiber-containing down-feather wadding of the present invention, short fibers 2 are entangled in barbs 4 (including tiny barbs 6) of down-feathers as shown in FIG. 1.

Especially, the tiny barbs 6 have knots 6*a* to prevent separation of the short fibers 2. It is advisable to heat set the short fibers 2. The short fibers are curled through the heat-setting, and the curled short fibers are entangled in the barbs 4 and the tiny barbs more strongly.

The short fibers may be the above-mentioned short fibers, namely, chemical fibers such as rayon, polyester fibers, acrylic fibers and polyamide fibers, and natural fibers such as cotton, hemp, silk and wool. When functional short fibers to be described later are used, chemical fibers which can be formed by incorporating chemicals, to which various activities can easily be imparted and which have a resistance to washing are preferable.

The size of the short fibers is usually between 1 and 30 denier, preferably between 1 and 15 denier, more preferably between 2 and 5 denier. The length thereof is usually between 1 and 50 mm, preferably between 3 and 50 mm, more preferably between 5 and 10 mm. When the size of the short fibers is too small, the bulkiness is reduced. When it is too large, the short fibers are hard to incorporate and easy to separate. When the length of the short fibers is too short, the bulkiness is reduced, and the short fibers are easy to separate. When it is too long, the short fibers are hard to incorporate.

The amounts of the short fibers incorporated are usually between 1 and 100 parts, preferably between 50 and 60 parts, more preferably between 10 and 50 parts per 100 parts of down-feathers. When the amounts of the short fibers incorporated are too small, the effect provided by incorporating the short fibers is hardly provided. When the amounts are too large, the short fibers which cannot be entangled in the barbs of the down-feathers remain, making it difficult to conduct the uniform entanglement.

(2) When the product is obtained using the following functional chemical or natural fibers as the short fibers, the following effects are brought forth.

1. Use of chemical fibers containing ceramics which generate far infrared rays:

A down-feather mattress or comforter increases in the heat-retaining property as compared to a conventional product. Further, down wear can contain down-feathers in smaller amounts than a conventional product, making it possible to provide a product having a relatively low bulkiness.

2. Use of chemical fibers having a high impact resilience:

A down-feather mattress or comforter, or a sleeping bag is bulkier than a conventional product, and can contain warm air in a larger amount, increasing the warm-retaining property.

3. Use of chemical or natural fibers containing a deodorant, a microbicide and an acaridan-proofing agent:

These chemicals can uniformly be dispersed in the down-feather wadding through the chemical or natural fibers, and the resistance to washing can be imparted thereto. Thus, the wadding can be expected to apply to a comforter and a mattress that prevents a bedsore or the like for patients.

4. Use of chemical fibers containing a fire protecting agent and a fire retardant:

A mattress, a comforter and the like can be rendered fire-retardant. Thus, it is expected that the product can be used in hospitals, hotels and the like requiring a high level of fire protection.

5. Use of chemical fibers containing magnetic and anion generating agents:

The magnetic and anion generating agents can uniformly be dispersed into the down-feather wadding through the chemical fibers, making it possible to provide a mattress, a comforter, down wear, underwear and the like that help to promote health.

B. A process for producing the above-mentioned short fiber-containing down-feather wadding is described below. The process of the present invention substantially comprises the following entangling step (1) and heat-setting step (2).

(1) Entangling step of stirring short fibers and wet down-feathers given after the washing in a mixing bath containing a surfactant-type softener and as required, an acid to entangle the short fibers into the down-feathers A general purpose commercially available softener can be used as the surfactant-type softener, and it may be a nonionic, anionic or cationic softener. The above-mentioned acid acts to improve an entangling property of fibers having an unsatisfactory entangling property in the entangling step.

The acid is not particularly limited unless it remains and has an adverse effect on short fibers and down-feathers. Especially, organic acids such as acetic acid, propionic acid and adipic acid are preferable because these acids disappear when they are dried.

(i) The above-mentioned wet down-feathers can be prepared by the following methods.

1) When raw down-feathers are used, a washing method is not particularly limited. For example, the following method is employed.

Figure 2:
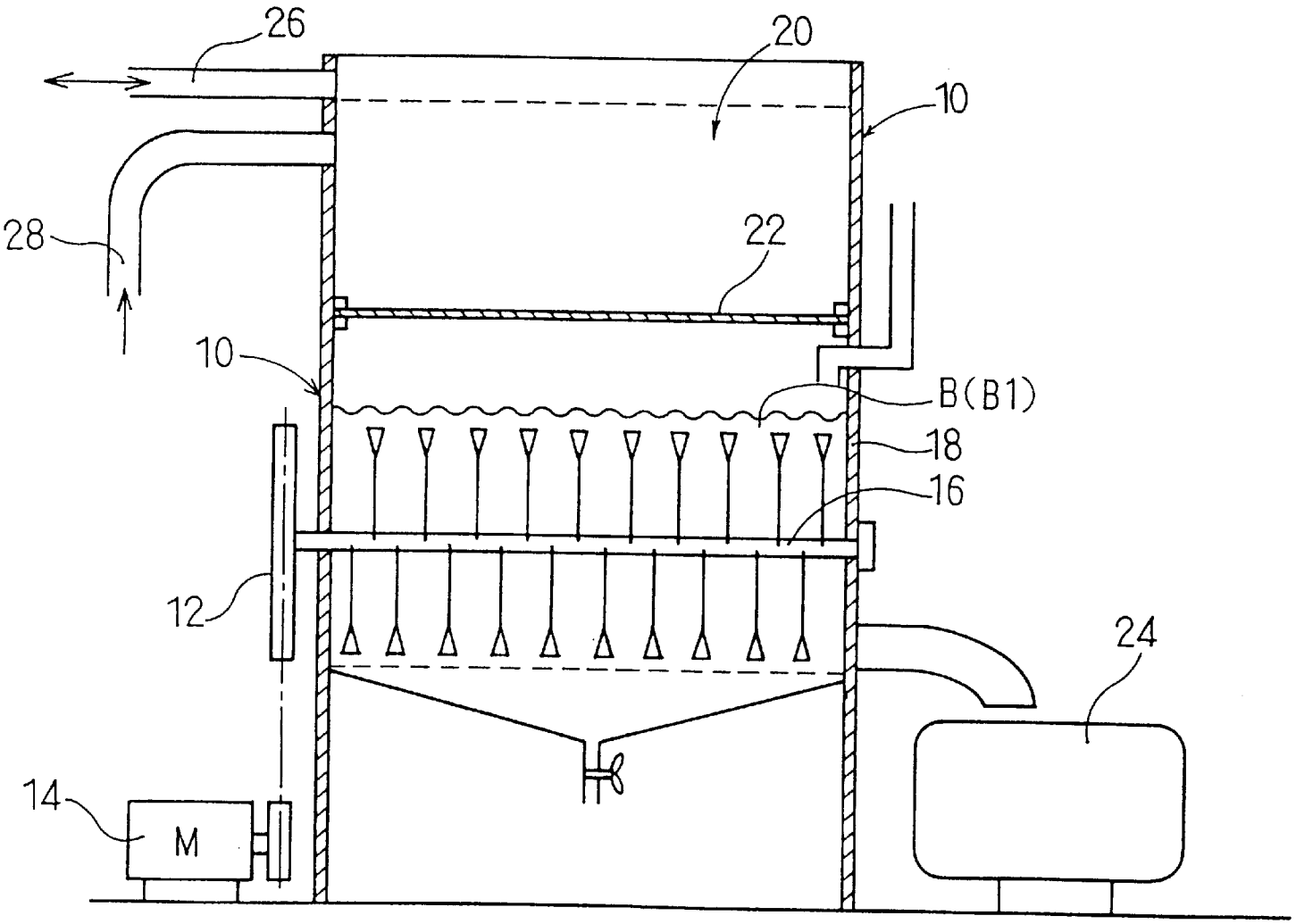
FIG. 2 is a simplified cross-sectional view of an example of a washing machine which is used in one process of the present invention.

A stirring device 10 fitted with a means of charging down-feathers as shown in FIG. 2 is used. In this stirring device 10, a stirrer 16 which is driven by a motor 14 through a pulley 12 is mounted on a stirring bath 18. Warm water held at from 40 to 60° C., preferably from 50 to 60° C. is charged into the stirring bath 18 in an amount of 40 to 60 times by weight as large as the amounts of the down-feathers charged. A neutral detergent (combination of nonionic and anionic detergents) is added thereto at a concentration of from 0.05 to 0.5% by weight, preferably from 0.1 to 0.2% by weight based on water to prepare a treating bath B. A rid 22 closed which is disposed under a down-feather hopper 20 is opened to drop the down-feathers into the treating bath B, and the down-feathers are washed at a bath temperature of from 50 to 60° C. for from 15 to 50 minutes, preferably for from 20 to 40 minutes. After water is drained, the down feathers are re-washed, then rinsed four or five times, and as required, dehydrated using a dehydrator 24 to complete the step of washing the down-feathers. When the dehydration is not conducted, only water may be drained after the completion of the rinsing.

2) When commercially available refined down-feathers are used, the washing is basically unnecessary, and only the treatment of dipping the same in a nonionic surfactant-containing dipping solution may be conducted.

Specifically, the same stirring device 10 as that in the above-mentioned washing step is used as a device of the dipping treatment. A dipping bath B1 is prepared by charging warm water of from 40 to 45° C. in an amount of from 40 to 60 times by weight as large as the amounts of the down-feathers charged, and adding a nonionic surfactant at a concentration of from 0.01 to 0.1% by weight, preferably from 0.02 to 0.04% by weight while stirring the same. The refined down-feathers are dropped into the dipping bath B1 as in the above-mentioned 1), and are dipped at a bath temperature of from 35 to 40° C. for from 10 to 15 minutes while being stirred. After water is drained, the rinsing is conducted once. Water is drained to complete the step of dipping the down-feathers.

The above-mentioned starting materials and refined down-feathers are charged into the down-feather hopper 20 such that air suction is conducted through an air suction-feed inlet 26 and the down-feathers are then charged into a down-feather feed inlet 28.

(ii) The entangling step is specifically conducted as follows.

The short fibers are added to the above-mentioned wet down-feathers filled in the stirring bath 18, subsequently the surfactant-type softener is added, in an amount of from 1 to 10% by weight, preferably from 5 to 7% by weight on the basis of the total amount (dry weight: this applied to the following) of the down-feathers and the short fibers, and an acid and the like are added thereto as required. The mixture is stirred at a temperature of from 30 to 50° C., preferably from 35 to 40° C. for from 10 to 15 minutes such that a bath ratio is between 1:80 and 1:150, preferably between 1:100 and 1:120, whereby the short fibers are entangled into the barbs of the down-feathers. That is, the short fibers are easily entangled into the barbs of the down-feathers while being softened. The bath ratio refers to a ratio of an amount of the product to be treated (total amount of the down-feathers and the short fibers) to an amount of a treating solution (total weight of water, a softener, an acid and the like). The amount of the acid to be added varies depending on the strength of the acid and the type of the short fibers. It is usually between 0.1 and 5 g/liter, preferably between 0.5 and 2 g/liter.

Before the above-mentioned entangling step, the short fibers may be subjected to a softening treatment step of softening the same in a softening bath containing the above-mentioned surfactant-type softener, and the above-mentioned softening bath may be used as the entangling bath.

In the softening treatment, warm water held at from 30 to 40° C. is charged into the stirring bath 18 in an amount of from 40 to 60 times as large as the amounts of the down-feathers charged using, for example, the above-mentioned stirring device. The surfactant-type softener is added thereto in an amount of from 5 to 10 parts per 100 parts of the down-feathers, and they are dissolved well to prepare a softening bath. The predetermined amounts of the short fibers are charged into the softening bath, and the stirring continues to conduct the softening treatment at from 35 to 40° C. for from 1 to 5 minutes.

After the above-mentioned softening treatment, the charging of the down-feathers is conducted progressively in the entangling step using the softening bath as the entangling bath (for example, the total amount of the down-feathers is treated for from 1 to 5 minutes), and the stirring is conducted in a bath ratio of from 1:100 to 1:150 at from 35 to 40° C. for from 10 to 15 minutes.

Since the short fibers are softened and dispersed in the softening bath, these short fibers can easily be entangled into the barbs of the down-feathers.

Figure 3:
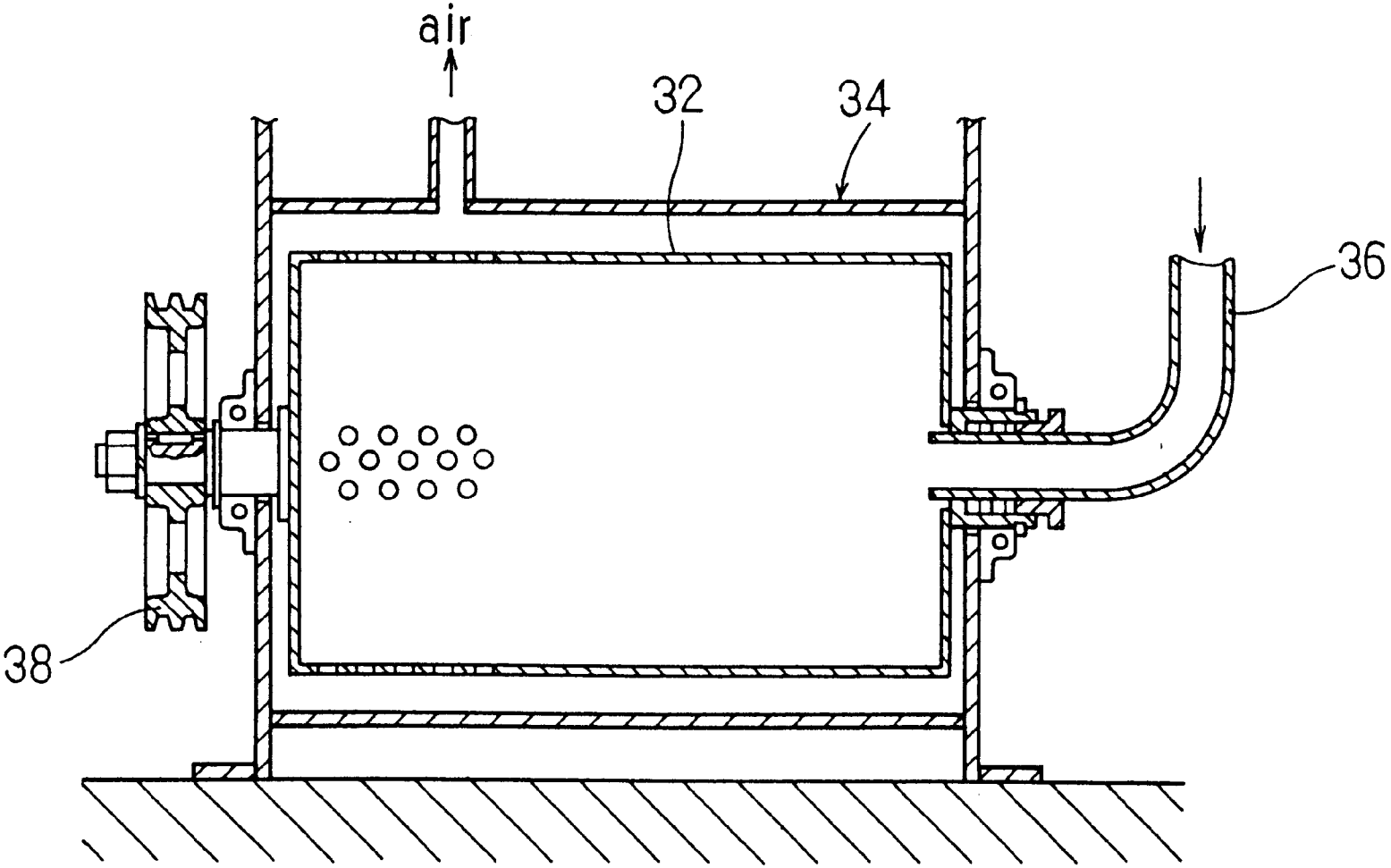
FIG. 3 is a simplified cross-sectional view of a closed-type dehydration washing machine in the present invention.

In the above-mentioned embodiment, the wettable down-feathers are used. However, when refined down-feathers are treated with a closed-type entangling bath, for example, as shown in FIG. 3, a dehydration washing machine 34 fitted with a perforated rotary drum 32, down-feathers which are originally not wet are also available. The reason is as follows.

Since the dehydration washing machine 34 is of a closed type, the refined down-feathers and the short fibers are charged from a starting material feed inlet 36, and warm water (held at from 40 to 50° C.), a surfactant and a softener are fed thereto, and the operation is conducted at a predetermined bath ratio (for example, 1:100) for from 10 to 15 minutes, making it possible to make wet the refined down-feathers. Then, the short fibers can be entangled into the barbs of the down-feathers in warm water.

In the case of using this closed-type dehydration washing machine, the entangling step and the dehydration can successively be conducted to improve the productivity. In the case of the refined down-feathers, a step of imparting a wettability can be conducted at the same time, whereby the productivity is further improved. By the way, 38 is a pulley for driving the rotary drum.

(2) Step of dehydrating and drying the above-mentioned mixture and then heat-setting the same:

The heat-setting conditions vary depending on the type of the short fibers. For example, in the case of rayon, the heat-setting is conducted at from 100 to 120° C. for from 2 to 5 minutes, preferably at from 110 to 120° C. for from 3 to 5 minutes. This heat-setting helps to curl the short fibers 2 entangled in the barbs 4 and 6 of the down-feathers, whereby the short fibers 2 are hardly separated from the down-feathers.

Figure 4:
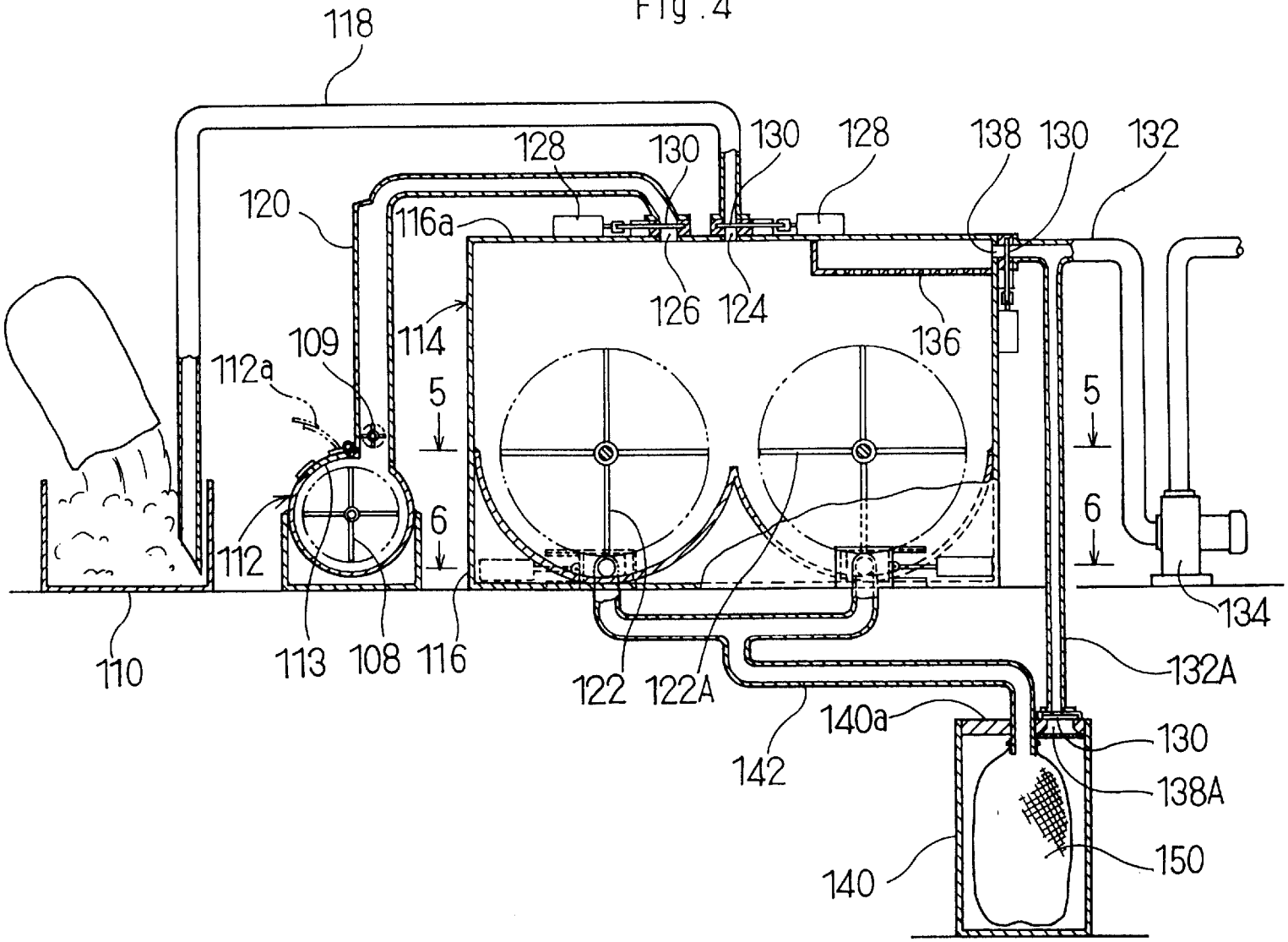
FIG. 4 is a simplified cross-sectional view of one apparatus which is used in the other process of the present invention.

C. The apparatus which is used in the other process for producing the short fiber-containing down-feather wadding is described below (refer to FIGS. 4 to 6).

This apparatus is basically fitted with a down-feather charge bucket 110, a short fiber loosening machine 112, and a machine 114 for mixing down-feathers with short fibers (hereinafter simply referred to as a "mixer").

The down-feather charge bucket 110 and the short fiber loosening machine 112 are connected in nearly a central position of a top portion 116*a* of a mixer case 116 of the mixer 114 through a down-feather feed duct 118 and a short fiber feed duct 120 such that the down-feathers and the short fibers can be fed through suction.

The short fiber loosening machine 112 is of a horizontal drum type. It is provided at a shaft position with a main loosening stirring blade 108 and at a feed outlet with an auxiliary loosening stirring blade 109, and has a starting material feed inlet 113 with an opening/closing rid 112*a*. The main loosening stirring blade 108 and the auxiliary loosening stirring blade 109 are designed to be able to increase or decrease the number of rotations.

Figure 5:
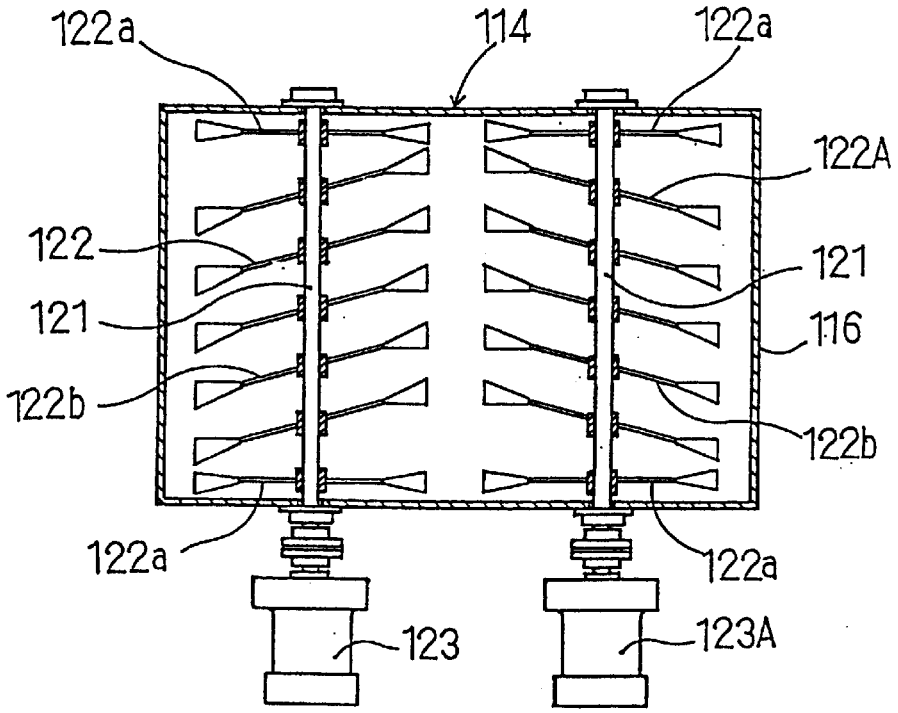
FIG. 5 is a view of an end taken along line 5—5 of FIG. 4.
Figure 6:
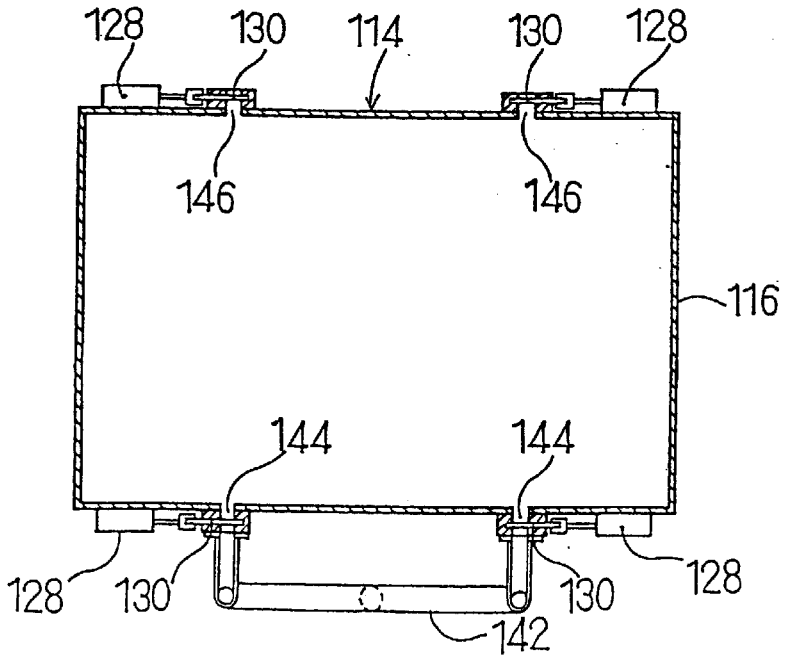
FIG. 6 is a view of an end taken along line 6—6 of FIG. 4.

The mixer 114 has, as shown in FIG. 5, a pair of first and second stirring blades 122, 122A of a screw type which are mounted horizontally. The stirring blades 122, 122A are directly connected with first and second motors 123, 123A of which the rotations are independently controllable. Blade elements 122*a* on both ends are perpendicular to a rotary shaft 121, but a middle blade element 122*b* is inclined. The intersecting angle between the middle stirring blade 122*b* and the rotary shaft 121 is usually between 65° and 85°, preferably approximately 75°.

A down-feather feed inlet 124 and a short fiber feed inlet 126 which are ports for connection of the down-feather feed duct 118 and the short fiber feed duct 120 with the mixer case 116 is designed to be switchable by means of a switch damper 130 which is driven by an air cylinder 128 or the like.

The suction feeding of the down-feathers and the short fibers is conducted by means of an exhauster 134 connected with the top portion 116*a* of the mixer case 116 through an exhaust duct 132. Specifically, the top portion 116*a* is connected with the exhaust duct 132 through a plate 136 for preventing the scattering of a wadding which plate is made of a punching plate or the like in order not to scatter the wadding from the exhaust duct 132. A suction port 138 for connecting the mixer case 116 with the exhaust duct 132 is provided with the above-mentioned switch damper 130. An exhauster 134 is adapted to optionally control an amount of air exhausted.

In the present invention, a wadding storage box 140 is further provided which is connected with the bottom of the mixer case 116 through a wadding feed duct 142. Specifically, the wadding feed duct 142 is forked, and the two portions thereof are connected with sides at lower portions of axes of the screw-type stirring blades 122, 122A to form a pair of wadding feed outlets 144, 144. Air feed inlets 146, 146 are formed on the opposite sides correspondingly to the wadding feed outlets 144, 144 in view of the smooth feeding out of the wadding. The wadding feed outlet 144 and the air feed inlet 146 have the above-mentioned switch dampers 130.

The top portion 140*a* of the wadding storage box 140 is connected with the exhauster 134 through the exhaust duct 132A. A suction port 138A for connecting the wadding storage box 140 with the exhaust duct 132A has the above-mentioned switch damper 130.

D. A process for producing a short fiber-containing down-feather wadding using the above-mentioned apparatus is described below.

In the present invention, the short fiber-containing down-feather wadding is basically produced by charging the washed down-features into the mixer 114, then charging the short fibers loosened by means of the short fiber loosening machine (hereinafter simply referred to as "loosening machine") 112 into the mixer 114, and mixing the down-feathers and the short fibers in the mixer 114. This process is specifically described below.

(1) The motors 123, 123A of the mixer 114 and the exhauster 134 are actuated, and the damper 130 of the down-feather feed inlet 124 of the mixer 114 and the damper 130 of the suction port 138 are switched on. At this time, the remaining dampers 130 are off.

(2) The down-feathers which have been washed are charged into the down-feather charge bucket 110. Then, the down-feathers are charged into the mixer from the down-feather charge bucket 110 through the down-feather feed duct 118.

(3) When the down-features are completely charged into the mixer 114, the damper 130 of the down-feather feed inlet 124 in the mixer 114 and the damper 130 of the suction port 138 are switched off and the exhauster 134 is stopped.

(4) Since the motors 123, 123A of the mixer 114 are still actuated, the down-feathers are stirred. It is advisable to control the rotations of the first and second stirring blades 122, 122A of the mixer 114 as follows.

The first/second stirring blades are rotated for every fixed period of time (for example, 1 minute) in the following manner.

1st rotation: clockwise/clockwise

2nd rotation: counterclockwise/counterclockwise

3rd rotation: clockwise/counterclockwise

4th rotation: counterclockwise/clockwise (5) Subsequently, predetermined amounts of the short fibers (which have been softened as required) are charged into the loosening machine 112, and this loosening machine 112 is actuated. The number of rotations of the exhauster 134 is decreased by means of an inverter, and the exhauster 134 is actuated with a decreased amount of air exhausted. Further, the damper 130 of the short fiber feed inlet 126 in the mixer 114 and the damper 130 of the suction port 138 are switched on. At this time, the remaining dampers 130 are off.

The short fibers loosened are then charged from the loosening machine 112 into the mixer 114 stirring the down-feathers, in small amounts. Thus, the short fibers are mixed with the down-feathers.

When the short fibers are completely charged into the mixer 114, the dampers 130 of the short fiber feed inlet 126 and of the suction port 138 are switched off and the loosening machine 112 and the exhauster 134 are stopped. At this time, the mixer 114 is still actuated.

(6) Subsequently, the amount of air exhausted in the exhauster 134 is returned to the original amount (maximum amount), and the dampers 130 of the wadding feed outlets 144, 144 and the dampers 130 of the air feed inlets 146, 146 in the mixer 114 and the damper 130 of the suction port 138A in the wadding storage box 140 are switched on. At this time, the outlet of the wadding feed duct 142 is connected with an airflowable wadding recovery bag 150 such as a hemp bag or the like.

Then, the wadding in the mixer 114 is stored into the wadding recovery bag 150 through the wadding feed duct 142. When the wadding is completely stored, the respective dampers 130 are all switched off.

Before the wadding is stored into the wadding recovery bag 150, the heat-setting can also be conducted as required by feeding hot air or the like into the mixer 114. The heat-setting conditions vary depending on the type of the short fibers. For example, in the case of rayon, the heat-setting is conducted at 100° C. for from 3 to 5 minutes.

EXAMPLES

The present invention is illustrated specifically by referring to the following Examples.

Example A (1) Step of imparting a wettability to down-feathers:

1. Washing of raw down-feathers:

Five-hundred liters of warm water held at 50° C. were charged into a stirring bath 10 shown in FIG. 2, and 500 g of a commercially available neutral detergent were added thereto, and dissolved while being stirred. Subsequently, 10 kg of down-feathers shown in Table 1 were charged therein, and washed with the solution for 30 minutes while maintaining the temperature at 50° C. After the solution was discharged, the resulting down-feathers were re-washed, rinsed four times, dehydrated, dried and recovered.

2. Dipping of refined down-feathers:

Five-hundred liters of warm water held at 40° C. were charged into the stirring bath 10 shown in FIG. 2, 0.03% of a nonionic surfactant were added thereto, and the mixture was stirred. Subsequently, 10 kg of refined down-feathers were charged therein, and stirred for 5 minutes. Subsequently, the solution was discharged. The resulting down-feathers were rinsed once, and dehydrated.

(2) Step of softening, entangling and heat-setting:

The stirring bath 18 filled with the wet down-feathers which had undergone the above-mentioned steps was charged with 7% by weight, based on the total amount of the down-feathers and the short fibers, of a surfactant-type softener and 1 g/liter of acetic acid, together with short fibers in amounts shown in Table 1. The mixture was stirred at a bath ratio of 1:100 for 10 minutes while maintaining the temperature of water at 40° C. Subsequently, the resulting product was dehydrated, dried at 80° C. for 15 minutes, and heat-set at 100° C. for 3 minutes.

(3) Test results:

The above-formed short fiber-containing down-feather wadding was measured for a texture and a feeling.

The results are shown in Table 1. From the results in Table 1, it is identified that an excellent texture and an excellent feeling are provided in all of Examples.

TABLE 1

| | Down/ feather | Short fiber | Softener *4) | Down-feathers/ short fiber | Texture and Feeling |
|---|---|---|---|---|---|
| Ex. 1 | *1) = 90/19 | Rayon 10 mm | Softess (cat-ionic) | 70/30 | excel-lent |
| Ex. 2 | " | " | " | 80/20 | excel-lent |
| Ex. 3 | " | " | " | 90/10 | excel-lent |
| Ex. 4 | *2) = 80/20 | Rayon 5 mm | KF123 (cat-ionic) | 70/30 | excel-lent |
| Ex. 5 | " | " | KF125 (ani-onic) | " | excel-lent |
| Ex. 6 | *3) = 70/30 | Acryl 10 mm | KF127 (non-ionic) | " | excel-lent |

Ex. - Example
*1) Raw down-feathers
*2) Refined down-feathers
*3) Raw down-feathers
*4) "Softess": Trade name for a product of The Lion Fat and Oil Co, Ltd. "K123, 125, 127"; Trade names for products of Takemoto Yushi K.K.

Example B (1) Washing of down-feathers:

A stirred down-feather washing machine shown in FIG. 1 was charged with 500 liters of warm water held at 50° C., and 500 g of a commercially available neutral detergent. They were stirred, and dissolved, and 10 kg of down-feathers were charged therein, and washed for 30 minutes while maintaining the temperature at 50° C. After the solution was discharged, the resulting down-feathers were re-washed, rinsed four times, dehydrated, recovered, and dried.

(2) Softening of short fibers:

A stirred down-feather washing machine shown in FIG. 1 was charged with 500 liters of warm water held at 140° C., and 100 g of a softener were added thereto. Three kilograms of short fibers (rayon containing ceramics:3 denier×110 mm) were charged therein, and the mixture was stirred. After the solution was discharged, the resulting down-feathers were dehydrated, recovered, and dried.

(3) Mixing of down-feathers with short fibers:

The washed down-feathers and the softened short fibers were charged into a down-feather charge bucket 110 and a loosening machine 112 in an apparatus shown in FIG. 1, and were mixed with each other. The respective devices and the mixing conditions are mentioned below.

loosening machine: main stirring blade—200 rpm
sub-stirring blade—200 rpm mixer: first stirring blade—50 rpm
second stirring blade—50 rpm mixing time:
The first/second stirring blades were rotated in the following manner.
1st rotation: clockwise/clockwise, 120 minutes
2nd rotation: counterclockwise/counterclockwise, 120 minutes
3rd rotation: clockwise/counterclockwise, 120 minutes
4th rotation: counterclockwise/clockwise, 120 minutes (4) Test results:

The above-formed short fiber-containing down-feather wadding was measured for a texture. As a result, the texture was found to be excellent.

What is claimed is:

1. A filling material comprising down-feathers mixed with short fibers, wherein the short fibers are entangled in barbs of the down-feathers and the short fibers are curled by heat-setting, obtained by (1) stirring short fibers and washed down-feathers in a mixing bath containing a surfactant-type softener to entangle the short fibers into barbs of the down-feathers, and (2) dehydrating and drying the entangled mixture, and then heat-setting the resultant mixture.

2. The filling material of claim 1, wherein the short fiber are functional fibers.

3. The filling material of claim 1, wherein the short fibers have a size of from 1 to 20 denier and a length of from 1 to 50 mm.

4. A filling material comprising down-feathers mixed with short fibers, wherein the short fibers are entangled in barbs of the down-feathers and the short fibers are curled by heat-setting, obtained by (1) stirring short fibers and washed wet down-feathers in a closed-type mixing bath containing a surfactant-type softener to entangle the short fibers into barbs of the down-feathers, and (2) dehydrating and drying the entangled mixture, and then heat-setting the resulting mixture.

5. The filling material of claim 4, wherein the short fibers are functional fibers.

6. The filling material of claim 4, wherein the short fibers have a size of from 1 to 20 denier and a length of from 1 to 50 mm.

* * * * *